US012090544B2

(12) United States Patent
He et al.

(10) Patent No.: US 12,090,544 B2
(45) Date of Patent: Sep. 17, 2024

(54) REBAR UPSETTING PROCESS AND REBAR UPSET FORGING MACHINE

(71) Applicant: ZHEJIANG RUICHENG MACHINERY MANUFACTURING CO., LTD., Zhejiang (CN)

(72) Inventors: Chengtao He, Zhejiang (CN); Zhengjun Cheng, Zhejiang (CN); Dong Wei, Zhejiang (CN); Fengfeng Jiang, Zhejiang (CN); Yandong Wang, Zhejiang (CN); Manchen Liu, Zhejiang (CN)

(73) Assignee: ZHEJIANG RUICHENG MACHINERY MANUFACTURING CO., LTD., Zhejiang (CN)

( * ) Notice: Subject to any disclaimer, the term of this patent is extended or adjusted under 35 U.S.C. 154(b) by 0 days.

(21) Appl. No.: 18/533,405

(22) Filed: Dec. 8, 2023

(65) Prior Publication Data

US 2024/0131575 A1 Apr. 25, 2024
US 2024/0226993 A9 Jul. 11, 2024

Related U.S. Application Data

(63) Continuation of application No. PCT/CN2021/105017, filed on Jul. 7, 2021.

(30) Foreign Application Priority Data

Jun. 22, 2021 (CN) ..... 202110694592.1

(51) Int. Cl.
*B21K 1/56* (2006.01)
*B21J 5/08* (2006.01)

(52) U.S. Cl.
CPC .. *B21K 1/56* (2013.01); *B21J 5/08* (2013.01)

(58) Field of Classification Search
CPC .... B21K 1/56; B21K 1/766; B21J 5/08; B21J 7/18; B21J 9/06
See application file for complete search history.

(56) References Cited

U.S. PATENT DOCUMENTS 5,660,594 A * 8/1997 Viljakainen ..... B21K 1/56 470/10
5,799,528 A 9/1998 Camping
(Continued)

FOREIGN PATENT DOCUMENTS

CN 201644690 U 11/2010
CN 104511561 A 4/2015
(Continued)

OTHER PUBLICATIONS

DE 102010011260A1, Pieper Sep. 2011.*
(Continued)

*Primary Examiner* — Edward T Tolan
(74) *Attorney, Agent, or Firm* — Cooper Legal Group, LLC

(57) ABSTRACT

A machine and its associated process for upset forging the ends of deformed reinforcement bars are disclosed. The machine includes 2 split clamping dies and an upsetting die, and they are housed in separate casings so that the clamping action is independent from the upsetting die. The clamping dies and the upsetting die form a continuous cavity for accommodating the forging of long bars. The upsetting die has a upsetting cavity with radial closed cross-section, and the whole forging process is performed inside this closed cavity to ensure it's a true closed-die forging process, which results in precise upset diameter with improved roundness of the rebar.

8 Claims, 5 Drawing Sheets

(56) References Cited

U.S. PATENT DOCUMENTS

| | | | | |
|---|---|---|---|---|
| 6,735,994 | B2 * | 5/2004 | Buhler | B21F 5/00 72/20.1 |
| 7,313,942 | B2 | 1/2008 | Braun | |
| 9,266,165 | B2 * | 2/2016 | Dahl | B21J 5/022 |

FOREIGN PATENT DOCUMENTS

| | | | |
|---|---|---|---|
| CN | 205926972 | U | 2/2017 |
| CN | 207464081 | U | 6/2018 |
| CN | 111203508 | A | 5/2020 |
| CN | 111590008 | A | 8/2020 |
| JP | 2003290862 | A | 10/2003 |

OTHER PUBLICATIONS

DE 4122158A1, Rengers et al. Jan. 1993.*
International Search Report of Corresponding Application No. PCT/CN2021/105017; Mar. 22, 2022; 5 Pgs.

* cited by examiner

REBAR UPSETTING PROCESS AND REBAR UPSET FORGING MACHINE

CROSS-REFERENCE TO RELATED APPLICATION

This application is a continuation of PCT application serial no. PCT/CN2021/105017, filed on Jul. 7, 2021, which claims the priority and benefits of China patent application no. CN 2021/10694592.1, filed on Jun. 22, 2021. The entireties of PCT application serial no. PCT/CN2021/105017 and China patent application no. CN 2021/10694592.1 are hereby incorporated by reference herein and made a part of this specification.

TECHNICAL FIELD

The present application relates to cold or hot head-forging, also known as "upsetting", of long metal bars, and in particular, to a forging machine for the upsetting of deformed reinforcement bars and a rebar upset forging process.

BACKGROUND ART

1. In construction industry, a widely-used technique for connecting reinforcement bars is to make threads on the ends of the rebars, which allows them to be connected to each other via an internally-threaded connector, commonly referred to as a rebar coupler. The connection strength should exceed the strength of the rebar itself.

2. Deformed reinforcement rebars are covered with longitudinal and transverse ribs along their entire length. To make a thread on the end of the rebar, it is necessary to firstly remove these ribs to obtain a smooth and round surface with minimal deviations. However, this process reduces the effective cross-sectional area of the threaded portion, resulting in a weaker connection strength than the strength of the rebar itself, regardless of whether the threading is produced by cutting or rolling.

3. In order to ensure that the final thread cross-sectional area is not smaller than that of the original rebar itself, it is necessary to increase the diameter of the rebar's end. This increase in diameter at the end of the rebar can be achieved through cold or hot upset forging processes, commonly referred to as "upsetting".

4. Unlike general industrial products that have precise dimensions, rebars of the same size can exhibit significant differences and deviations in outer diameter, the shape and height of transverse and longitudinal ribs, and the basic circular cross section of the rebars, due to different manufacturers and production standards. The upsetting process not only increases the cross-sectional area of the rebar's end but also serves the important function of unifying these differences and deviations to the standard upset diameter and basic circular cross-section. This facilitates the subsequent threading process, ensuring the production of qualified threads.

Examples from FIGS. 3 and 4 in U.S. Pat. No. 7,313,942B2 demonstrate two different structures that differ in their die closing methods. The first example utilizes a separate hydraulic cylinder for die closing, while the second example employs a wedge-shaped block and a wedge slide for the same purpose that is providing a sufficient die closing force (or locking force).

The commonality between these two structures lies in the following facts. 1. The dies are divided into two halves along the axial direction of the rebar. This allows for the rebar to be inserted when the dies are open and removed after upsetting. Once the dies are closed, they form a clamping cavity and an upsetting cavity, facilitating the upsetting process. 2. Both the clamping dies and upsetting dies are split dies, and they are housed within a single pair of casings. Due to this configuration, the opening and closing of the casings lead to the simultaneous opening and closing of the clamping dies and upsetting dies.

The defects of the existing structures are as follows. 1. Since the clamping dies and upsetting dies are housed in the same pair of casings, the clamping force exerted on the casings is divided into two distinct forces. One force is employed by the clamping dies to secure the rebar against the axial forging force, while the other force acts on the upsetting dies to counteract the radial expansion force from the rebar during the upsetting process. This radial expansion force is so substantial that a significant clamping force is required. 2. Due to variations in rebar diameter, because both the clamping dies and the upsetting dies are housed within the same pair of casings, specific challenges arise. For rebars with a smaller diameter, the clamping dies might not secure the rebar adequately even when the casings are fully closed, leading to a clamping failure. Conversely, for rebars with larger diameters, the clamping dies may clamp the rebar firmly before the casings are fully closed. This prevents the casings and upsetting dies from closing completely, resulting in an upsetting cavity that exceeds the required dimensions. 3. Given that the clamping dies and upsetting dies are split dies and housed in the same pair of housings, the dimensions of the upsetting cavity change with the varying diameters of the rebar, therefore, it is not feasible to allow the heading tool to enter the upsetting cavity, which otherwise would cause damage. Consequently, most of the upsetting is performed outside the cavity, which means the process is not a true closed-die forging and often leads to the formation of a flange at the end of the rebar, commonly referred to as caps. Such caps are unfavorable to the subsequent threading process. 4. After the upsetting process is completed, the casings open, causing both the clamping dies and upsetting dies to open simultaneously. This can often result in the rebar getting stuck on one of the dies, requiring workers to use tools to remove it. This presents a challenge in automating the entire operation.

Therefore, due to the aforementioned structural defects, the existing structures can only increase the cross-sectional area of the rebar's end, failing to control the upset diameter and the cross-sectional shape precisely.

SUMMARY

The purpose of the present application is to address the issue of inconsistent upset diameter and shape resulting from the lack of dimensional accuracy of deformed reinforcement bars in existing technologies. The present application aims to provide a forging machine and an upset forging process capable of upset forging the end of deformed reinforcement bars to an accurate and uniform upset diameter with improved roundness, so as to facilitate their subsequent threading, despite the wide variation of diameters, the rib shapes and rib dimensions due to the nature of deformed bars.

According to the present application, the forging machine has clamping dies and upsetting die housed in separate casings while the clamping dies and upsetting die form a continuous cavity so as to allow long deformed steel bars to go through one side of the machine. The clamping dies are split dies that can be closed independently to grip the rebar in position, while the upsetting die is a solid die with a closed radial cross-section, so that the rebar end is compressed in its length direction by the forging force in an upsetting cavity with a closed radial cross-section. This process is known as true closed-die forging or flash-less forging, and allows for accurate forged dimensions to be achieved.

Since the upsetting die is a solid die that cannot be opened, it is not possible to release the rebar by opening the solid upsetting die due to the expansion of the upset rebar end. Therefore, the heading tool is used not only for forging but also for pushing the rebar end out of the upsetting cavity, so that the rebar is ejected after the forging is completed.

The present application will be better understood from the following description together with the drawings that are an integral part of it. This demonstrates the advantages of the present application.

DETAILED DESCRIPTION OF THE INVENTION

Figure 1:
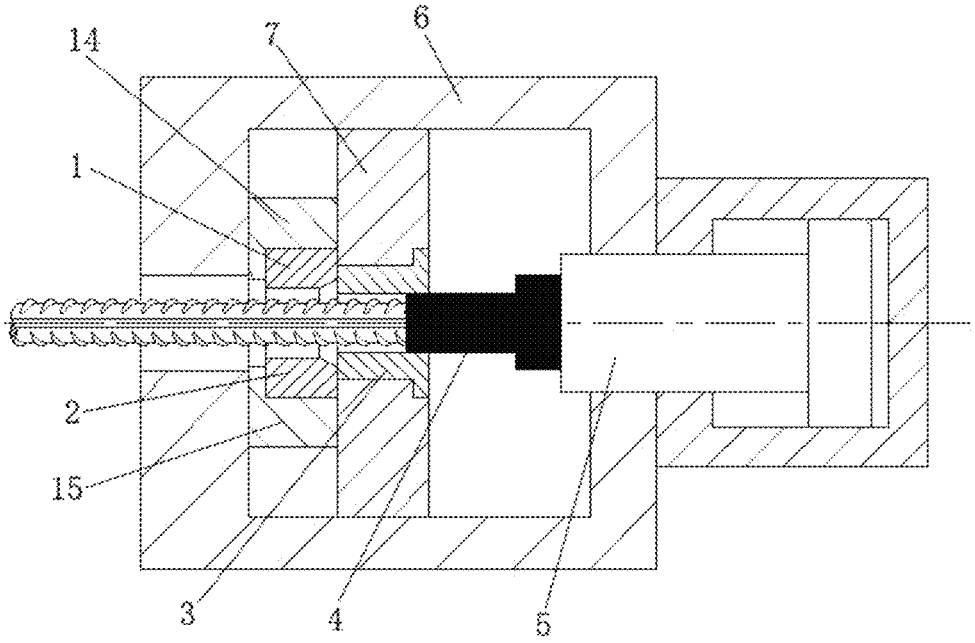
FIG. 1 is a schematic diagram illustrating an exemplary first embodiment of the present application in the state of placing the rebar and positioning the heading tool.

The following description is essentially exemplary and is not intended to limit the scope of the present application disclosed herein or its applications or uses. It should be understood that, in all the figures, corresponding reference numerals indicate the same or corresponding parts and features.

In the currently known related technologies, the upsetting cavity cannot form a completely enclosed cross-section radially around the rebar, and the dimensions of the cavity change with the variation of the rebar diameter. This results in poor consistency in the upsetting dimensions, cross-sectional shape, and roundness of the rebar. The poor quality of the upset rebar's end causes significant wear of a subsequent thread cutting tool, and renders it difficult to guarantee the quality of the thread. Additionally, extra clamping force is required to close the upsetting dies. In view of the above, the present application provides a rebar upsetting machine adopting true closed-die forging technology. As shown in FIGS. 1 to 4, the structural principle of the rebar upsetting machine according to an exemplary first embodiment of the present application is described in details. The frame 6 adopts a conventional structural design and will not be described in detail here. The frame 6 is equipped with clamping dies, an upsetting die, and an upsetting power device. The clamping dies shown in the examples are split dies. The clamping dies include a first clamping casing 14 and a second clamping casing 15, on which a first clamping die 1 and a second clamping die 2, respectively, are provided for radial opening and closing actions. Such clamping die structures and clamping power device are conventional technologies. For instance, the clamping power device may utilize independent hydraulic cylinders to open/close the clamping casings based on the force direction depicted in FIG. 2. In alternative embodiments, a wedge-shaped clamping mechanism can be positioned vertically atop the clamping casings to facilitate the opening and closing of the clamping dies. The upsetting die described in this application is a solid die with closed radial cross-section, which is different from any existing technology with split dies and is independent from the clamping dies. In this embodiment, both the first clamping die 1 and the second clamping die 2 have semi-circular clamping cavities. When closed together, they form a clamping cavity for securely gripping a rebar. To cater to the upsetting requirements of different rebar sizes, both clamping dies are designed with a modular structure, allowing for easy interchangeability. The upsetting die introduced in this application has a solid die with a closed radial cross-section. For instance, the illustrated embodiment in the figures show an upsetting die that includes an upsetting base plate 7 fixed to the frame 6. This base plate has a cylindrical hole, and the centerline of this hole aligns with the centerline of the clamping cavity on the same axis as the rebar. The cylindrical hole can directly serve as the upsetting cavity for the formation of the rebar head. However, to flexibly accommodate the upsetting of different rebar sizes, the cylindrical hole is not used directly as the upsetting cavity. Instead, it's used to house the upsetting die 3. The upsetting die 3 is designed modularly to fit different rebar sizes. While the upsetting die 3 is a solid die, it can adopt a multi-piece structure. Using fastening bolts, the multi-piece of the upsetting die are installed in the cylindrical hole to form an upsetting cavity with a high-precision radially closed cross section. To accommodate the modularly structured upsetting die 3, other shapes of installation holes can also be made on the upsetting base plate 7. Moreover, apart from the upsetting base plate structure mentioned in this embodiment, which is used as a base for housing the upsetting die 3, the hole structures, and the upsetting cavity structure formed by assembling modular components, any other mechanical design can be adopted. As long as it can form the upsetting cavity having the same structure and function as the upsetting cavity disclosed in this application, it falls within the protection scope of the present application. Unlike current technologies, this solid die has a consistently closed cavity structure. It remains unopened throughout the entire rebar head upsetting process. Due to its fixed and tightly closed state, it can withstand the expansion forces generated during the rebar head deformation without any cavity deformation. Consequently, there's no reliance on additional power devices to exert substantial clamping forces, ensuring precise control over the upset diameter and cross-sectional shape. Furthermore, with the clamping system being independent from the upsetting die, it eliminates the issues arising from variations in rebar diameters, ensuring that there are no failures in gripping the rebar or closing the upsetting die. Additionally, as the heading tool 4 enters the upsetting cavity, the entire forging process occurs within this cavity. This design prevents problems like off-center forging or the formation of caps on the rebar head, which could arise if part of the forging were outside the upsetting cavity. Thanks to the fixed closed cavity structure's ability to withstand greater radial expansion forces from the rebar during the forging process, even longitudinal ribs of the rebar can be effectively flattened, achieving a precise upsetting diameter and improved roundness. Also the upset head can be pushed out by the heading tool, which eliminates the problem of rebar sticking to the dies, making it easy for automated production.

Figure 2:
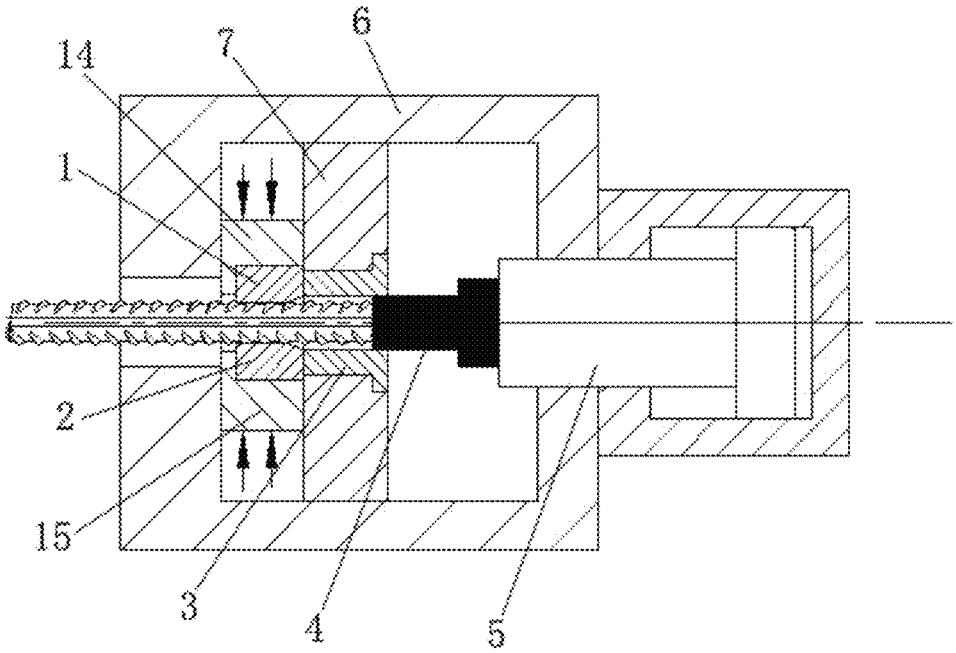
FIG. 2 is a schematic diagram illustrating an exemplary first embodiment of the present application in the state of closing the clamping dies and initiating the upsetting process.
Figure 3:
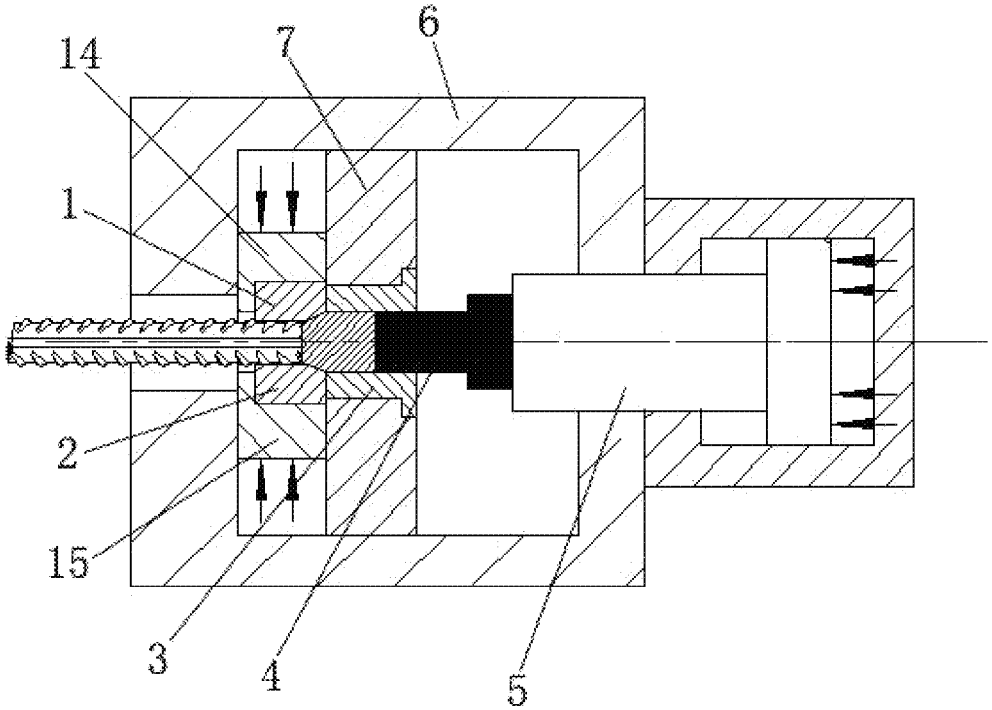
FIG. 3 is a schematic diagram illustrating an exemplary first embodiment of the present application in the state of completing the upsetting action.
Figure 4:
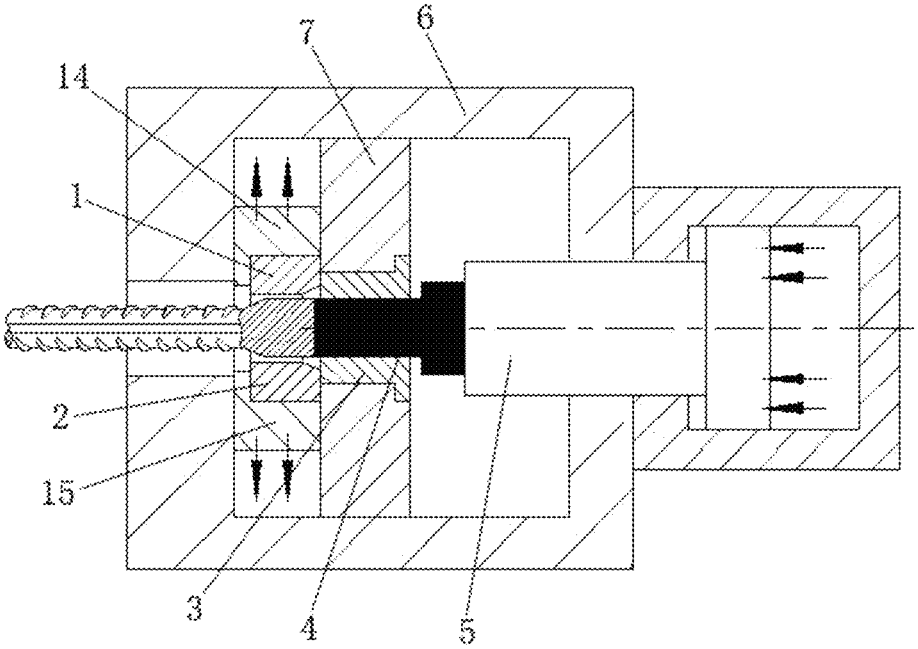
FIG. 4 is a schematic diagram illustrating an exemplary first embodiment of the present application in the state of pushing out the upset section after opening the clamping dies.

Referring to the illustrative rebar head upsetting process shown in FIGS. 1 to 4, the embodiment shown in the figures utilizes a hydraulic system as the upsetting power device, which includes a cylinder. A piston 5 is mounted on this cylinder, and a heading tool 4 is installed on the piston 5. As depicted in FIG. 1, when the first clamping die 1 and the second clamping die 2 are opened to receive the rebar, the heading tool 4 moves in advance to the upsetting position. The rebar to be upset is then inserted through the clamping cavity and the upsetting cavity until the upsetting end face of the rebar comes into contact with the heading tool 4. Referring to FIG. 2, with the clamping dies 1 and 2 closed, the clamping dies secure the rebar in the clamping cavity against the forging force. The heading tool 4 extends to start the upsetting action. Referring to FIG. 3, it shows the transition between the upset part and the non-upset part of the rebar is located on the clamping dies. The heading tool enters the upsetting cavity, compressing the rebar in the length, so that the rebar in the upsetting die expands in diameter while the part of the rebar in the transition section of the clamping dies is formed to a V-shaped transition section. Referring to FIG. 4, as the transition V section is on the clamping dies, when the clamping dies 1 and 2 open, the heading tool extends further into the upsetting cavity to push the upset head out of the upsetting cavity by the forging force provided from the forging cylinder. Then the rebar can be taken out from the opened clamping dies. To achieve automated operation of the rebar head upsetting process, pressure and displacement sensors can optionally be installed on the frame 6 to measure the pressures and displacements of the clamping die, upsetting die, and upsetting power device, all under the control of a controller. The aforementioned automation solutions can be realized using conventional techniques and will not be elaborated further.

As shown in FIGS. 5 to 10, according to the exemplary second embodiment of the present invention, the structural principle of the forging machine of the present application is elaborated. In this embodiment, the frame 6 is a tie-rod structure of existing public technology, which is not repeated here. A movable plate 13, which slides axially along the guide rods, is mounted the guide rods. The movable plate 13 is driven to move axially by a power device which is not shown in the figure, for instance, driven by using a hydraulic cylinder or other methods. The displacement can be detected by a displacement sensor to precisely control the speed and displacement of the movable plate 13. As shown in FIGS. 5 to 10, the clamping dies illustrated in the embodiment uses a wedge-shaped clamping mechanism. The clamping dies consists the clamping casings 9 and 10, and clamping dies 11 and 12 housed in the clamping casings respectively, the clamping dies 11 and 12 have a semi-circular clamping cavity. When the clamping dies close, they form a clamping cavity for holding and fixing the rebar. In order to accommodate different rebar sizes, the wedge-shaped clamping dies 11 and 12 adopt modular design for easy change of dies. The wedge-shaped clamping casings 9 and 10 are installed on the transverse sliding rail of the movable plate 13, and are able to move along the rail so that the casings open/close. A stationary plate 8 is positioned in front of the movable plate 13 and it has a wedge-shaped opening with guide grooves. When the movable plate 13 is driven to move axially by the clamping power device, the wedge-shaped casings 9 and 10 are driven to move into or out of the wedge-shaped slideway and synchronously open or close the clamping dies 11 and 12. The structure of the upsetting cavity in the movable plate 13 is the same as the first embodiment. As shown in the figure, the clamping dies 11 and 12 are chamfered at the end that abuts against the upsetting cavity, serving as a transition zone between the non-upsetting part and the upset part of the rebar.

Figure 5:
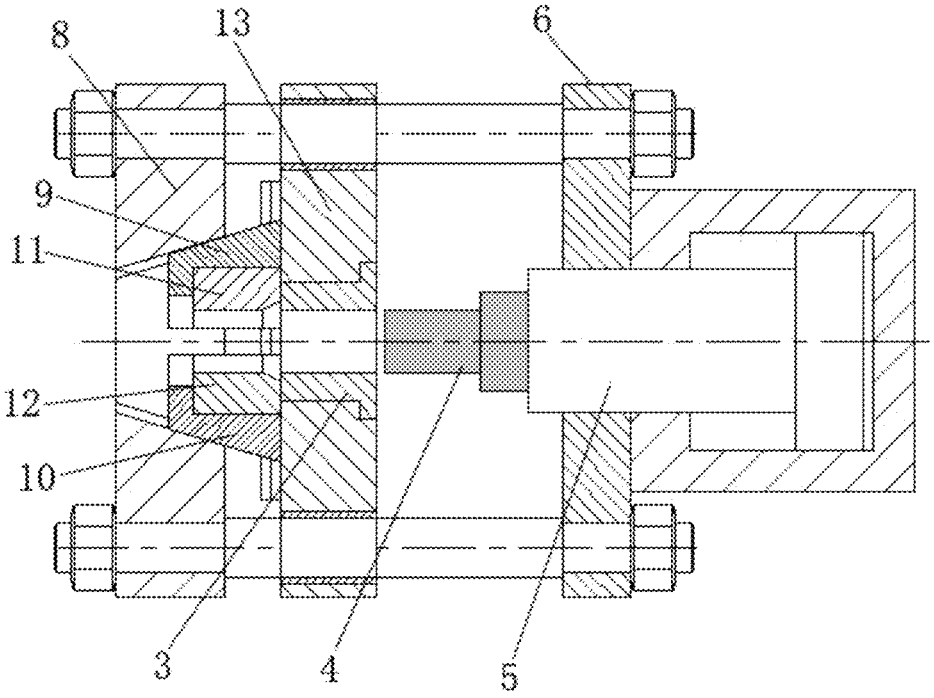
FIG. 5 is a schematic diagram illustrating an exemplary second embodiment of the present application in the state of opening the wedge-shaped clamping dies.
Figure 6:
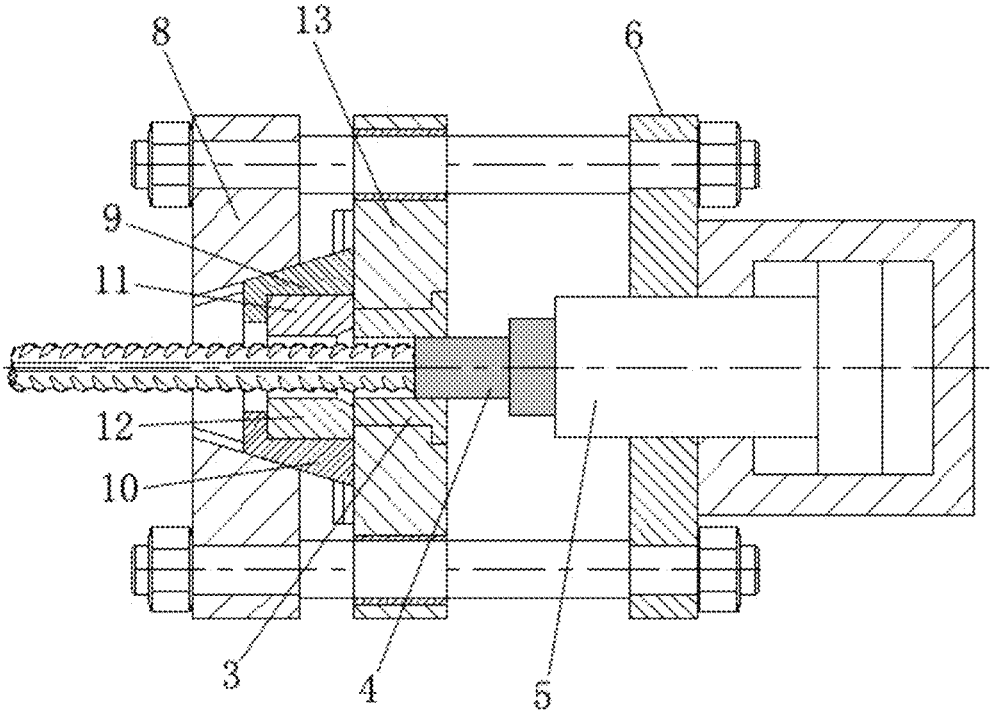
FIG. 6 is a schematic diagram illustrating an exemplary second embodiment of the present application, showing the rebar positioned with its upsetting end in contact with the heading tool.
Figure 7:
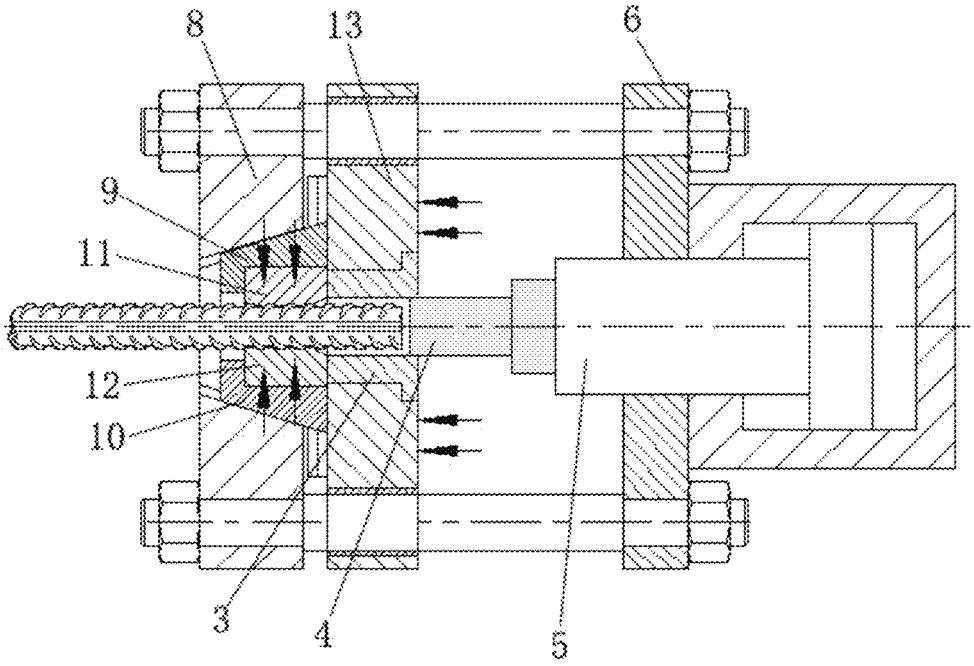
FIG. 7 is a schematic diagram illustrating an exemplary second embodiment of the present application in the state of completing the clamping of the rebar after closing the wedge-shaped clamping dies.
Figure 8:
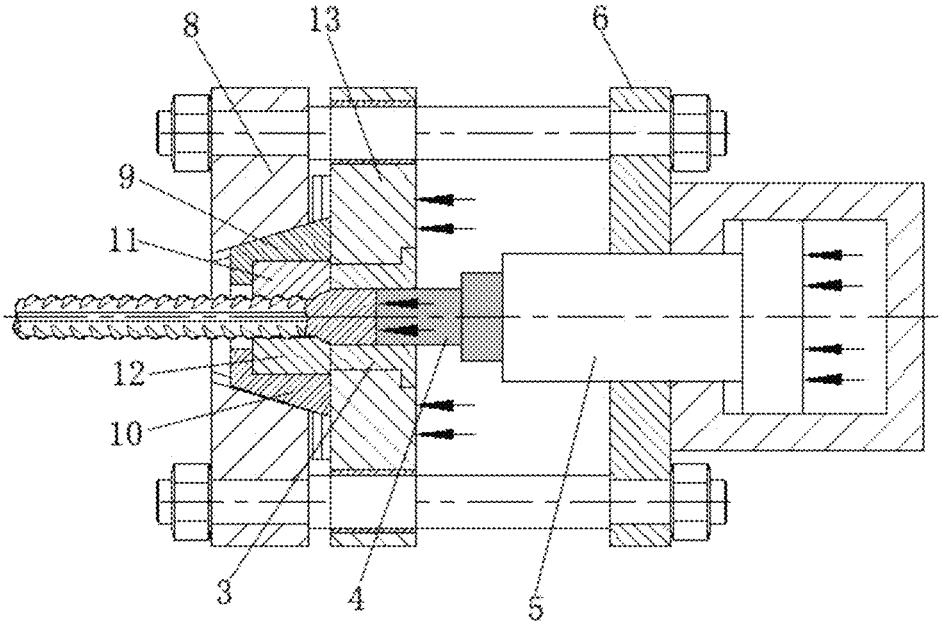
FIG. 8 is a schematic diagram illustrating an exemplary second embodiment of the present application in the state of completing the upsetting action.
Figure 9:
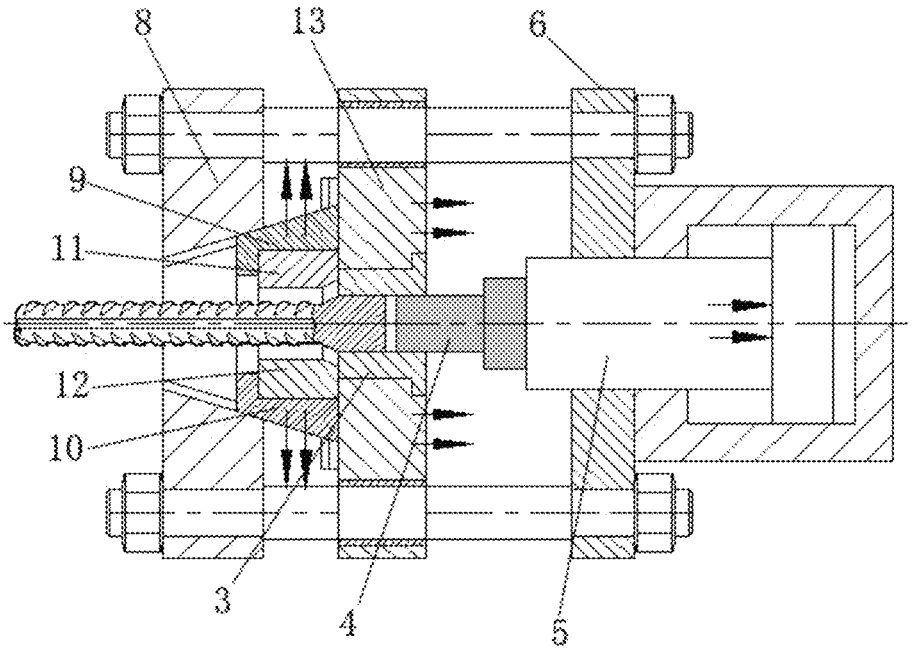
FIG. 9 is a schematic diagram illustrating an exemplary second embodiment of the present application in the state of retracting the heading tool and opening the wedge-shaped clamping dies.
Figure 10:
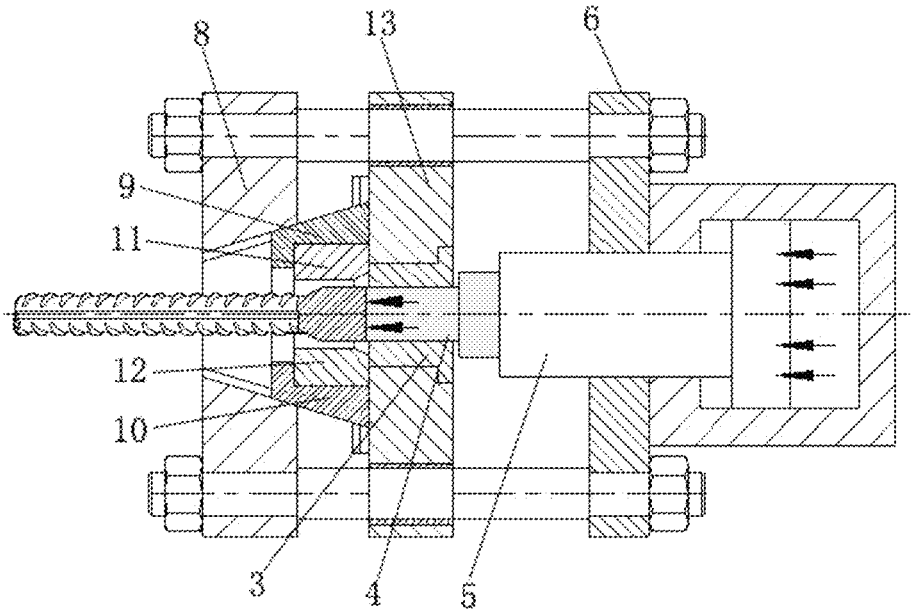
FIG. 10 is a schematic diagram illustrating an exemplary second embodiment of the present application in the state of pushing out the upset section by the heading tool.

Referring to the exemplary upset forging process of the end of the rebar shown in FIGS. 5 to 10, the upset forging power device shown in the embodiment is the same as the first embodiment. Referring to FIG. 5, the movable plate 13 moves toward the piston 5 so the clamping casings 9 and 10 open to open the clamping cavity. Referring to FIG. 6, the heading tool 4 is moved to the pre-set positioning position under the action of the piston, and the rebar to be upset is inserted from the opening in the stationary plate 8, passed through the clamping dies and the upsetting die, and stopped by the heading tool 4. Referring to FIG. 7, the movable plate 13 moves toward the stationary plate so the clamping dies 11 and 12 close radially as the casings enter the wedge-shaped opening deeper, completing the clamping of the rebar. Referring to FIG. 8, the heading tool 4 moves forward and upsets the rebar in the upsetting cavity. The rebar in the upsetting cavity is compressed in length and expanded in diameter, while the rebar in the transition section is formed like a V-shaped transition due to the chamfer on the end of the clamping dies. When the heading tool reach its pre-set position and the hydraulic pressure reaches its pre-set value, the upsetting is completed. Referring to FIG. 9, first, the heading tool 4 retracts to provide space for the movable plate 13 move backward, and then the movable plate 13 moves backward to open the clamping dies 11 and 12. Referring to FIG. 10, the heading tool 4 moves forward and extends into the upsetting cavity to push the upset section of the rebar out the upsetting cavity so that the rebar ejection is completed. Due to the radial expansion of the rebar head during the forging process, great ejection force is needed to push the upset head out of the upsetting cavity and the movable plate 13 must remain in its position under this force, otherwise the clamping dies 11 and 12 will close as the movable plate 13 moves forward under the ejection force. Therefore, a stopper (not shown in the figure) is needed between the stationary plate 8 and the movable plate 13 to prevent the movable plate 13 from moving, or, alternatively, the clamping power device can be used to provide the same force to prevent the movable plate from moving. After the rebar ejection is completed, the rebar can be taken out from the clamping cavity. To achieve automated operation of the rebar head upsetting process, displacement sensors can be used to measure the displacements of the movable plate 13 and the heading tool 4, and pressure sensors can be used to measure the hydraulic pressure, all under the control of a controller. A controlled and accurate upset diameter and good roundness can be achieved by adjusting the preset positions of the movable plate 13 and heading tool 4, and the hydraulic pressure, plus the verification between the displacement values and the pressure values. All these are conventional technologies and will not be elaborated further.

Although the foregoing descriptions have been described in connection with specific embodiments, it will be understood by those skilled in the art that variations, modifications, and substitutions can be made without departing from the scope of the invention. Moreover, adaptations for specific situations or materials that remain consistent with the essential scope of this disclosure are envisioned. Therefore, it is intended that the present disclosure is not limited to the particular embodiments disclosed, but will include all embodiments falling within the scope defined by the appended claims. The scope of the present application should be determined by the appended claims and their legal equivalents.

LISTING OF REFERENCE SIGNS

1. First clamping die
2. Second clamping die
3. Upsetting die
4. Heading tool
5. Cylinder
6. Machine frame
7. Upsetting base plate
8. Stationary plate
9. First wedge-shaped clamping casing
10. Second wedge-shaped clamping casing
11. First wedge-shaped clamping die
12. Second wedge-shaped clamping die
13. Movable plate
14. First clamping casing
15. Second clamping casing

What is claimed is:

1. A rebar upset forging machine, comprising:

a machine frame provided with clamping dies, wherein the clamping dies form a clamping cavity that is configured to be opened and closed and is configured for holding rebar;

an upsetting die mounted on the machine frame, wherein the upsetting die has an upsetting cavity with an enclosed cavity structure configured for upsetting and shaping an end of the rebar, and the upsetting die is configured as a solid die with a straight, closed radial cross-section that cannot be opened; and an upsetting power device provided on the machine frame, wherein centerlines of both the clamping cavity and the upsetting cavity align with each other, and one end of the clamping dies abuts against the upsetting die, and wherein the clamping dies are provided with a chamfer at the one end of the clamping dies abutting against the upsetting die.

2. The rebar upset forging machine according to claim 1, wherein the clamping dies are of a split structure, and the clamping dies are configured to open and close independently of the upsetting die.

3. The rebar upset forging machine according to claim 1, wherein the upsetting cavity has a completely closed radial cross-section along an axis of the upsetting cavity.

4. The rebar upset forging machine according to claim 1, wherein the clamping dies are housed in a wedge-shaped clamping casing configured for opening and closing of the clamping dies.

5. The rebar upset forging machine according to claim 4, wherein the wedge-shaped clamping casing is arranged along an axis of the rebar or perpendicular to the axis of the rebar.

6. The rebar upset forging machine according to claim 1, wherein the upsetting power device has a piston configured to move towards the end of the rebar, and a heading tool is provided on the piston and configured to enter the upsetting cavity for upsetting the end of the rebar inside the upsetting cavity during the upsetting.

7. A method of upsetting using the rebar upset forging machine according to claim 1, comprising the steps of: opening the clamping dies, inserting the rebar into the clamping dies and the upsetting die, closing the clamping dies, and performing the upsetting by using the upsetting power device.

8. The method according to claim 7, wherein after the upsetting, the clamping dies are opened and an upset end of the rebar is ejected from the upsetting die by the upsetting power device.

* * * * *